United States Patent [19]

Cusi

[11] 4,268,032

[45] May 19, 1981

[54] EXPANDER

[76] Inventor: Antoine Cusi, 35, Avenue du Bois-de-la-Chapelle, CH-1213 Onex, Switzerland

[21] Appl. No.: 109,455

[22] PCT Filed: Jun. 1, 1979

[86] PCT No.: PCT/CH78/00025

§ 371 Date: Jun. 5, 1979

§ 102(e) Date: May 22, 1979

[87] PCT Pub. No.: WO79/00181

PCT Pub. Date: Apr. 19, 1979

[30] Foreign Application Priority Data

Oct. 5, 1977 [CH] Switzerland ..... 12187/77

[51] Int. Cl.[3] ..... A63B 21/02

[52] U.S. Cl. ..... 272/137; 272/142; 272/143

[58] Field of Search ..... 272/137, 142, 143, 135, 272/130

[56] References Cited

U.S. PATENT DOCUMENTS

| | | | |
|---|---|---|---|
| 1,680,901 | 8/1928 | Meyer | 272/142 X |
| 2,356,260 | 8/1944 | Maxwell | 272/142 X |
| 2,529,347 | 11/1950 | Mohler et al. | 272/137 |
| 3,759,512 | 9/1973 | Yount et al. | 272/142 X |
| 4,023,796 | 5/1977 | Kusmer | 272/137 |

*Primary Examiner*—William R. Browne

*Attorney, Agent, or Firm*—Stevens, Davis, Miller & Mosher

[57] ABSTRACT

An expander is described having a pair of substantially U-shaped actuating arms. Each of the arms have a pair of branches connected together forming at one end a U member. The U members comprise a first pair of transoms. The arms are pivotally connected together near the transoms. A second pair of transoms connecting the branches of each arm support resilient structure, the resilient structure maintaining a tension between each of the transoms of the second pair with transoms of the first pair, whereby respective arms are biased apart.

3 Claims, 1 Drawing Figure

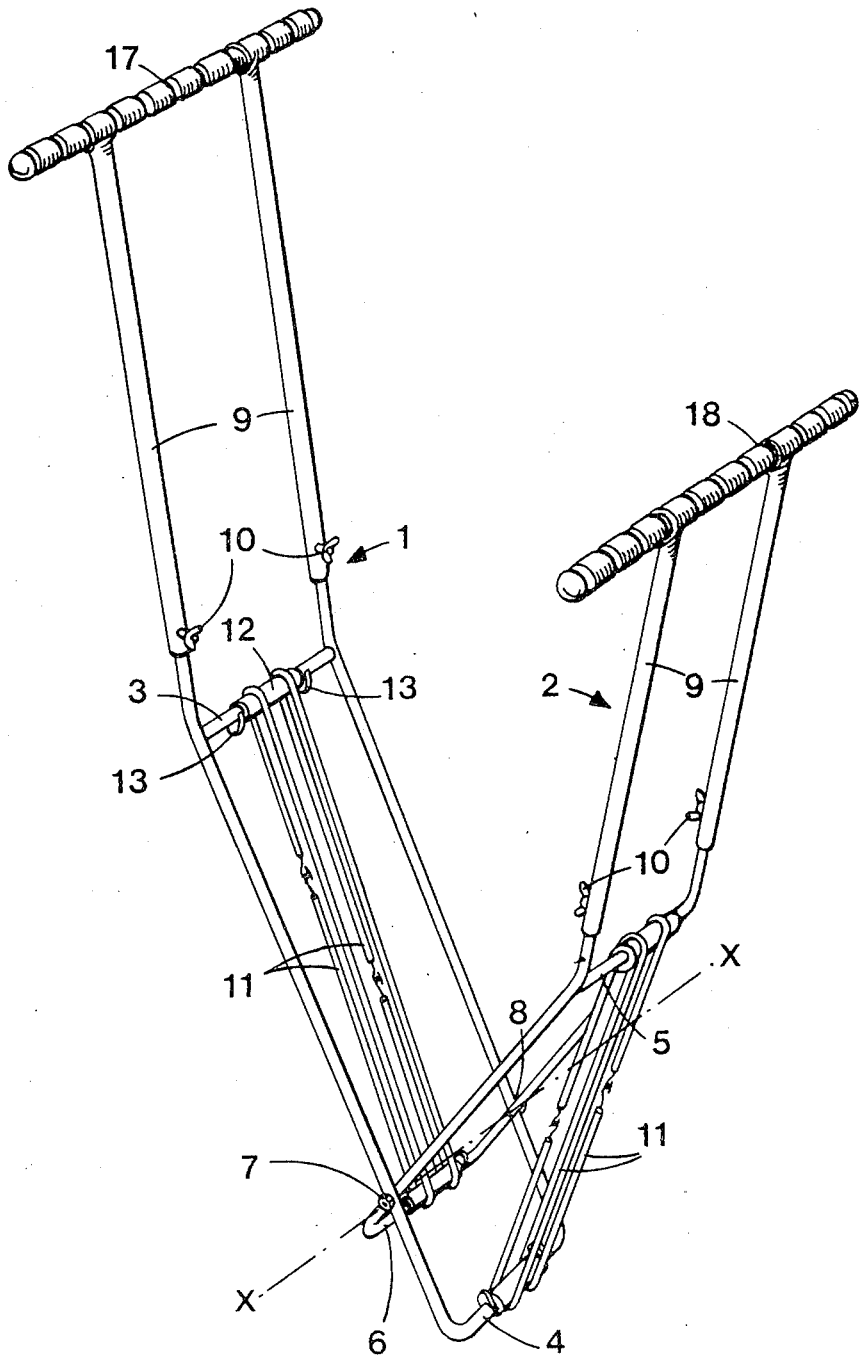
17
9
18
10
1
12
3
13
2
9
13
10
11
X
8
5
11
7
X
6
4

EXPANDER

The present invention relates to an expander, a gymnastic apparatus serving to develop the muscles, in which two activating bars are capable of being displaced one with respect to the other against the action of elastic return means.

The expander according to the invention is characterised in that it comprises two arms articulated to each other, each arm comprising hook members, elastic return means on one side and the other of the articulation, the actuating bars being fixed to one end of each arm.

The single FIGURE of the accompanying drawing represents one form of the expander which is the subject of the invention in perspective, diagrammatically and by way of example.

The expander shown in the drawing comprises two arms 1 and 2 articulated along the axis X—X and each having two transoms 3 and 4 and 5 and 6 respectively on one side and the other of the axis of articulation.

Each arm 1 and 2 is formed by a tubular part in the shape of a U the base of which constitutes the transom 4 and the transom 6 respectively. Two bolts 7 and 8 ensure the connection of the arms to each other along the axis of articulation X—X.

One transom 3 or 5 respectively is welded to the two sides of the tubular part constituting each arm 1 or 2 respectively in such a manner that the articulation is located between the transoms, nearer to that which is constituted by the base of the U. The free ends of the tubular part are bent at the level of the transoms 3 and 5 respectively, away from each arm towards the other arm so as to form an obtuse angle.

Two actuating bars 17 and 18 are each fixedly mounted at the end of two tubes 9 fitted to the free ends of a tubular part constituting one of the arms 1 or 2 and fixed to the latter by wing nuts 10. This arrangement enables the distance between each actuating bar 17 and 18 and the axis of articulation X—X to be adjusted.

Sleeves 12 are pivotally mounted on the transoms 3 to 6 and are maintained in longitudinal position by two clips 13 integral with each transom. Sandows 11 constituting elastic return means connect the opposite transoms 4 and 5, 3 and 6 of the two arms 1 and 2 together. These sandows are fixed around the sleeves 12, which prevents friction between the sandows and the transoms when the expander is being used.

With the arrangement of the sandows as represented in the drawing, the exercises are carried out by bringing the bars 17 and 18 together from an open position of the expander, in which the transoms 3 to 6 are substantially in one and the same plane, into a closed position in which the bars 17 and 18 are side by side. By virtue of the special arrangement of the hook locations with respect to the axis of articulation X—X, the force to be exerted on the bars 17 and 18 to bring them together against the action of the sandows 11 is weak in the extreme positions of the bars and is relatively strong and constant in the intermediate positions. This change in the force to be applied to the actuating bars 17 and 18 corresponds particularly well to the change in the muscular force which a person can produce in a movement between the two extreme positions of the body within the said movement.

By virtue of the fact that the arms 1 and 2 each have an obtuse angle, two opposite forces applied to the bars 17 and 18 when the expander is in the open position, create a couple tending to close the said expander. Moreover, when the bars 17 and 18 are closed one against the other, there still exists a return force in the open position in such a manner that the movements are effective up to the complete closure of the expander.

It is quite clear that, for certain exercises, the corresponding transoms 3 and 5, 4 and 6 of the arms 1 and 2 may be connected together by the sandows 11.

Numerous variants of the described expander can be provided and in particular elastic return means constituted by springs may be provided.

The expander could be constituted by two tubes articulated one to the other, each tube having attachment rings integral with the tube on each side of the articulation for fixing the sandows or the springs.

Equally, an expander could be provided with transoms the position of which is adjustable along the arms 1 and 2.

I claim:

1. An expander for physical exercises, comprising in substantially symmetrical combination:

a pair of substantially U-shaped actuating arms, each of said arms having a pair of branches connected together at one end forming a U member, said U members forming a first pair of transoms, said arms pivotally articulated together along an axis at right angles to the lengthwise direction of the arms near said transoms;

a second pair of transoms connecting the branches of said arms at right angles at a location opposite said first pair of transoms with respect to said articulation axis, said U-shaped branches being bent inwardly at an obtuse angle near or at the place of said second pair of transoms, the remaining ends of the branches of each arm being connected together by a handle; and resilient means connecting each transom of said first pair of transoms to a transom of said second pair of transoms, whereby said arms are biased away from each other.

2. An expander according to claim 1, wherein each branch of said arms comprises a tube slidably mounted beyond the second transom with respect to the U member and fixed thereto by wing nuts.

3. An expander according to claim 1, wherein said resilient means are sandows hinged to sleeves rotatably mounted on said transoms.

* * * * *